United States Patent [19]

Stalter

[11] 4,265,484

[45] May 5, 1981

[54] REINFORCED FOAMED BODY SUPPORT MEMBER

[75] Inventor: Robert J. Stalter, Bowling Green, Ohio

[73] Assignee: The Goodyear Tire & Rubber Company, Akron, Ohio

[21] Appl. No.: 37,785

[22] Filed: May 10, 1979

[51] Int. Cl.[3] ..... A47C 23/00

[52] U.S. Cl. ..... 297/452; 5/481; 297/DIG. 1; 297/456; 267/142

[58] Field of Search ..... 297/452–456, 297/DIG. 1, DIG. 2, 111; 267/142; 5/446–448, 464, 476, 478, 481, 500, 502

[56] References Cited

U.S. PATENT DOCUMENTS

| | | | |
|---|---|---|---|
| 3,140,086 | 7/1964 | Lawson | 297/452 X |
| 3,161,436 | 12/1964 | Hood | 297/452 |
| 3,319,274 | 5/1967 | Upton | 5/481 |
| 3,849,269 | 10/1974 | Ambrose | 5/478 |
| 4,064,578 | 12/1977 | Yamada | 297/452 |
| 4,073,020 | 2/1978 | Stalter | 5/481 |
| 4,092,751 | 6/1978 | Burkholder et al. | 5/481 |

*Primary Examiner*—Casmir A. Nunberg
*Attorney, Agent, or Firm*—J. D. Wolfe

[57] ABSTRACT

A polyurethane foamed body support member having an essentially inextensible plastic reinforcing member positioned below the surface of the foam and in the preferred embodiment has a density difference of at least 0.5 between the foam above and below said plastic member.

10 Claims, 3 Drawing Figures

REINFORCED FOAMED BODY SUPPORT MEMBER

TECHNICAL FIELD

This invention relates to an improved reinforced foamed body support member like a mattress or seat cushion. More particularly this invention relates to an improved reinforced foamed body of relatively low density.

BACKGROUND ART

Foamed body support members of either latex or polyurethane foam are well known. Generally these articles have relatively high densities of 3.2 for mattresses and 2.8 for automotive seat cushions, whereas the seat backs are only 2.2. Although there has been a need and desire to go to a lower density for both the mattress and seating foam this has not been practical with polyurethane as polyurethane foams have poor compression set or load bearing properties. Hence these relatively low density products are more prone to develop sinks where the body rests most often on the body support member. Therefore the industry has used relatively high densities to avoid this difficulty, and as a result these body support members are generally considered to have a harsh feel which was corrected by mechanical construction or means such as those described in U.S. Pat. No. 4,073,020.

DISCLOSURE OF THE INVENTION

These disadvantages can be avoided and overcome by positioning a relatively inextensible plastic or wire reinforcing member in the foam body at a point just below the functional design depth, i.e. a predetermined depth, preferably $3.1 \pm 1.0$ centimeters, below the top surface of the foam.

In those cases where the body support member contains grooved areas in the top thereof to reduce the harsh feel it is advantageous to have a relatively inextensible plastic reinforcing member positioned about 0.5 to 1.0 centimeters beneath the grooves and extending over into the non-grooved area. Especially is this desirable when the foam density is less than 2.8 and less than 2.2 respectively for a mattress or seat and a seat back.

DESCRIPTION OF DRAWINGS

The nature of this invention can be more readily seen and its advantages understood by reference to the drawings wherein.

Figure 1:
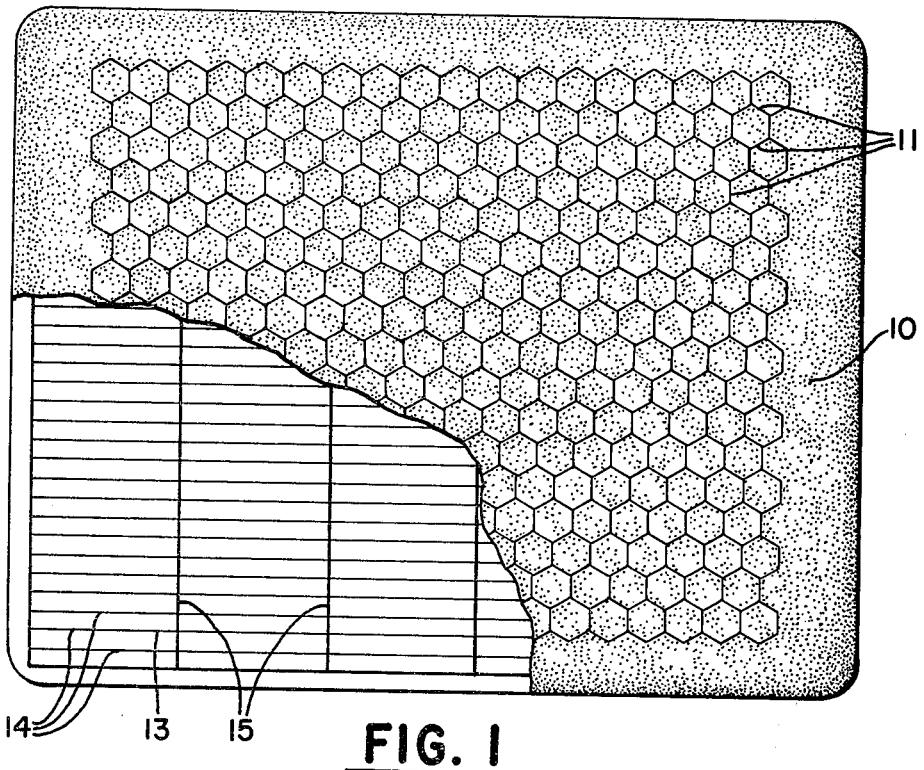
FIG. 1 is a plane view in partial section of a foam mattress core having a pattern of hexagonal grooves with a plastic reinforcing member therein.
Figure 2:
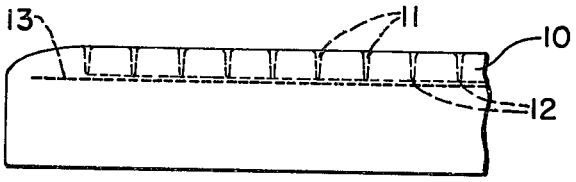
FIG. 2 is a partial end view of FIG. 1.

Referring specifically to FIG. 1, the numeral 10 designates a polyurethane foam mattress having hexagonal grooves 11 molded, burned or cut therein to reduce the harsh feel of the mattress. Also, embedded in the mattress below the bottom 12 of the grooves is a plastic mesh reinforcing member 13 which should be short of any edge of any seat foam. This plastic mesh member is preferred as it has essentially a fixed relationship between the warp strands 14 and the woof strands 15 and is therefore able to more uniformly distribute the loading over the foam.

BEST MODE FOR CARRYING OUT THE INVENTION

The nature of this invention is further illustrated by reference to the representative example where all parts and percentages are by weight unless otherwise indicated.

EXAMPLE

Figure 3:
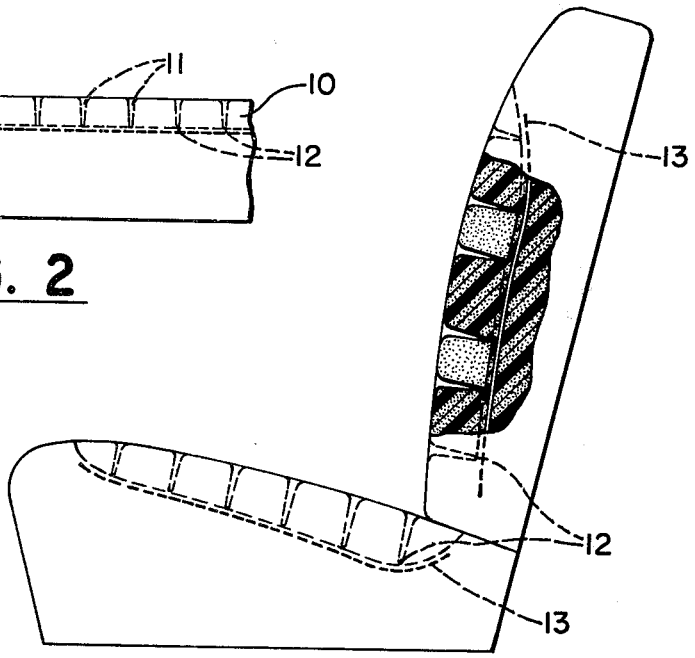
FIG. 3 is an end view of a seat in partial section.

A mattress mold of rectangular shape fitted with raised members or gates to give a hexagonal cored out or grooved effect in the crown area was used to cast a mattress. A molded polyethylene or polypropylene mesh reinforced member was positioned 0.5 centimeter above the gates so that it would be embedded in the poured or molded mattress. The mattress was poured with a pouring head that gives a fan-shaped pour pattern. Preferably two or more pouring heads are utilized as necessary, depending on the size of the article, that can pour a fan-shaped pattern. The operation of three pouring heads is shown in FIG. 3 of U.S. Pat. No. 4,073,020, each head being of the type described in U.S. Pat. No. 3,927,162. These three pouring heads pour a fan-shaped pattern that yields a crown-shaped mattress having the desired hexagonal grooved pattern with no air entrapment or large bubbles obtained with other pouring heads. Also, in one embodiment at least one pouring head is programmed to pour a polyurethane recipe that has a density 0.5 or more units greater than the other to produce a foam body support member having greater compression load bearing properties than the foam from the other pour head. This is especially desirable with the surface grooved mattress as grooves reduce the harsh feel of the higher density.

Once the polyurethane foamable reaction mixture of polyether polyol and an organic polyisocyanate and sufficient water to give a foam preferably of 2.5 to 3.5 density, depending on the nature of the body support members, is poured into the mold it is closed with a suitable lid. The foamable reaction mixture is allowed to foam and cure before the mattress core is stripped from the mold. The mattress core may have a geometric pattern of grooves or cored-out areas having lengths no more than about 9.8 centimeters before it terminates or changes directions. Thus the non-cored out portion of the crown area can be compressed individually for at least 10 percent of its height before adjacent non-cored out areas begin to deflect. Also the plastic reinforcing member is positioned at least 0.5 to 3.0 centimeters below the bottom of the groove.

This method of making a foam mattress permits it to be made with relatively high crowns, usually 1.27 to 2.54 centimeters in the center, without the person lying on the mattress feeling he is rolling off of it and resist the tendency of low density foams to form sinks.

To recapitulate, this method of making the mattress core comprises effecting relative movement between a pour means, preferably two or more pour heads, and a mold having a cavity with a mattress crown configuration in the bottom thereof. This curvature of the cavity to achieve the mattress crown configuration is divided by suitable gates or raised portions to give a cored-out pattern in the crown of the molded product, for instance a series of truncated pyramids or hexagonal members. The polyurethane mattress type foam reaction mixture is distributed in a fan-shaped arc in response to the relative movement between the pouring means and the mold to distribute the mixture from one end and over the gates to the other end of the mold. This relative movement may be achieved by manually moving the mold or the pouring means relative to each other or by apparatus such as described in U.S. Pat. No. 3,247,295 of J. E. Burwell. After the foamable liquid polyurethane reaction mixture of the mattress grade is distributed over the mold the mold having plastic reinforcing members positioned therein is closed and the mixture allowed to foam full and cure within the mold before removing the molded core from the mold.

The plastic reinforcing member preferably is a molded or extruded type of interlaced member of plastic such as polyethylene, polypropylene, polyvinyl chloride and similar plastics that are essentially nonelastomeric or have great resistance to elongation. The crosshatched strands may be positioned to form essentially a square or a rectangular cross-section with the strands in war plane being much larger than or the same size as the woof ones.

While certain representative embodiments and details have been shown for the purpose of illustrating the invention it will be apparent to those skilled in this art that various changes and modifications may be made therein without departing from the spirit or scope of the invention.

I claim:

1. A polyurethane foam body support member having a mesh reinforcing member positioned at a predetermined depth below the top surface thereof and the foam has a density of less than 2.8 and less than 2.2 when the body support member is, respectively, a mattress, or a seat and a seat back, said mesh reinforcing member stopping before reaching any edge of the foam.

2. The body support member of claim 1 wherein the reinforcing member is of metallic or wire construction.

3. The body support member of claim 1 wherein a surface of the body is divided into a decorative segment by cored-out areas, said cored-out areas being positioned to give a geometric pattern of not more than 9.8 centimeters in length before the grooves terminate or change directions to give raised portions, each portion being capable of being compressed independent of any other portion for at least 10 percent of its compression deflection.

4. The body support member of claim 3 wherein the geometric pattern is hexagonal.

5. The foam mattress core of claim 3 wherein the cored-out areas in the crown extend no closer than 2.54 centimeters of each edge of the core to leave an uncored strip adjacent each edge.

6. The foam mattress core of claim 3 wherein the geometric pattern is formed by curved members to leave raised portions inside said curved members.

7. The foam mattress core of claim 3 wherein the geometric pattern extends across the core on a bias to each edge.

8. The body support member of claim 1 wherein the reinforcing member is laminated between layers of foam.

9. The member of claim 1 wherein the reinforcing member is positioned $3.1 \pm 1.0$ centimeters below the top surface.

10. The member of claim 1 wherein at least part of the foam above the reinforcing member has a density of at least about 0.5 density units greater than the density of the foam beneath said member.

* * * * *